US010661585B1

(12) United States Patent
Onishi

(10) Patent No.: US 10,661,585 B1
(45) Date of Patent: May 26, 2020

(54) IMAGE FORMING APPARATUS

(71) Applicant: KYOCERA Document Solutions Inc., Osaka (JP)

(72) Inventor: Masato Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/784,568

(22) Filed: Feb. 7, 2020

Related U.S. Application Data

(62) Division of application No. 16/015,298, filed on Jun. 22, 2018, now Pat. No. 10,589,550.

(30) Foreign Application Priority Data

Aug. 1, 2017 (JP) ..... 2017-149411

(51) Int. Cl.
*B41J 29/02* (2006.01)
*B41J 29/13* (2006.01)
*B41J 2/01* (2006.01)

(52) U.S. Cl.
CPC ..... *B41J 29/02* (2013.01); *B41J 2/01* (2013.01); *B41J 29/13* (2013.01)

(58) Field of Classification Search
CPC ... B41J 29/13; B41J 29/02; B41J 2/01; G03G 21/1633; G03G 2221/169
USPC ..... 347/101, 104, 108
See application file for complete search history.

(56) References Cited

U.S. PATENT DOCUMENTS 6,899,422 B2 5/2005 Strowe et al.
7,653,328 B2 1/2010 Igarashi et al.
7,704,001 B2 4/2010 Igarashi

FOREIGN PATENT DOCUMENTS

JP 2001-019177 A 1/2001

*Primary Examiner* — An H Do
(74) *Attorney, Agent, or Firm* — Studebaker & Brackett PC

(57) ABSTRACT

An image forming apparatus includes a pair of support frames, an opening and closing door and a positioning structure. The support doors are arranged oppositely at both sides of an opening. The opening and closing door is supported by one of the pair of support frames via a turning shaft and turns around the turning shaft between a closing position and an opening position. The positioning structure positions the opening and closing door to the pair of support frames by engaging a convex part or a concave part provided in the pair of support frames with a concave part or a convex part provided in the opening and closing door in a state where the opening and closing door is turned to the closing position.

17 Claims, 9 Drawing Sheets

IMAGE FORMING APPARATUS

INCORPORATION BY REFERENCE

This application is a Divisional of U.S. patent application Ser. No. 16/015,298 filed Jun. 22, 2018 and is based on and claims the benefit of priority from Japanese Patent application No. 2017-149411 filed on Aug. 1, 2017, which is incorporated by reference in its entirety.

BACKGROUND

The present disclosure relates to an image forming apparatus.

An image forming apparatus is provided with an opening and closing door to open a side face of an apparatus main body in order to remove a sheet jammed at a conveying path.

For example, the image forming apparatus is provided with an exterior door and a turning guide. The exterior door is supported in a turnable manner around a turning shaft extending in the upper-and-lower direction along the side face of a casing. The turning guide is supported in a turnable manner around a turning shaft extending in the horizontal direction inside the exterior door to open the conveying path. Inside the exterior door, a recording sheet guide forming the conveying path for conveying the recording sheet is provided.

However, the above image forming apparatus has no consideration for positioning the exterior door with respect to the casing precisely. Thereby, every time when the exterior door is opened and closed, a position of the recording sheet guide with respect to the casing is varied. If the position of the recording sheet guide is considerably displaced from a suitable position, it becomes difficult to convey the recording medium suitably, and a jamming of the sheet may be occurred.

SUMMARY

In accordance with an aspect of the present disclosure, an image forming apparatus includes a pair of supporting frames, an opening and closing door, and a positioning structure. The support frames are arranged oppositely at both sides of an opening. The opening and closing door is supported by one of the pair of support frames via a turning shaft and turns around the turning shaft between a closing position where the opening and closing door closes the opening to form a part of a conveying path for a sheet and an opening position where the opening and closing door opens the opening. The positioning structure positions the opening and closing door to the pair of support frames by engaging a convex part or a concave part provided in the pair of support frames with a concave part or a convex part provided in the opening and closing door in a state where the opening and closing door is turned to the closing position. The positioning structure includes a first concave part, a first convex part, a second concave part and a second convex part. The first concave part is provided in one of the one support frame arranged on a side closer to the turning shaft and the opening and closing door. The first convex part is provided in the other of the one support frame and the opening and closing door and is inserted in the first concave part in the state where the opening and closing door is turned to the closing position. The second concave part is provided in one of the other support frame arranged on a side far from the turning shaft and the opening and closing door. The second convex part is provided in the other of the other support frame and the opening and closing door and is inserted in the second concave part in the state where the opening and closing door is turned to the closing position. The first convex part and the second convex part are protruded in directions perpendicular to each other.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
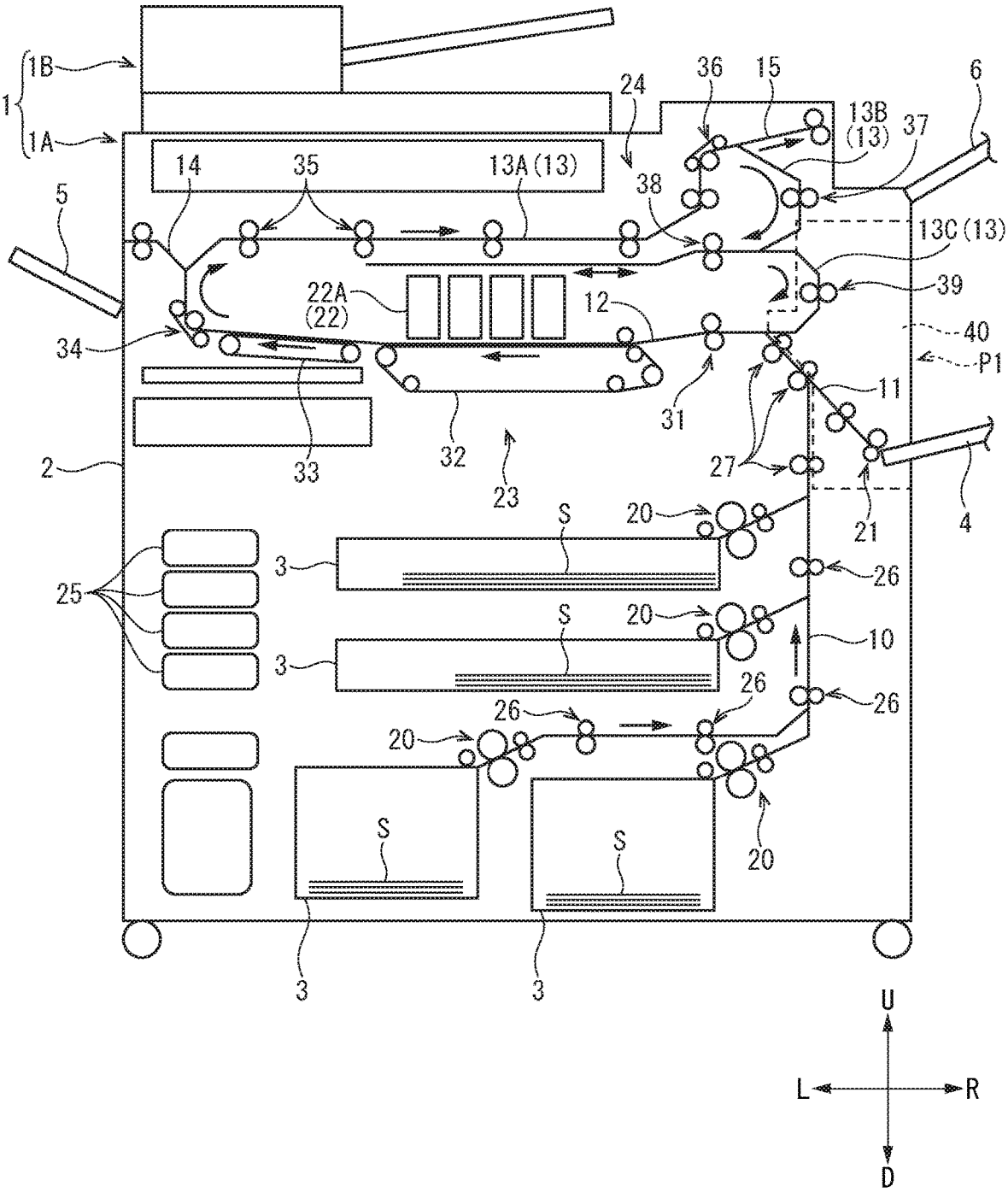
FIG. 1 is a sectional view schematically showing an inner structure of an image forming apparatus according to one embodiment of the present disclosure.

Hereinafter, with reference to the attached drawings, an embodiment of the present disclosure will be described. A near side of a paper surface of FIG. 1 is defined to be a front side. In each figure, "Fr" indicates "a front side", "Rr" indicates "a rear side", "L" indicates "a left side", "R" indicates "a right side", "U" indicates "an upper side" and "D" indicates "a lower side". In the following description, "a conveying direction" indicates a direction along which a sheet S is conveyed. Additionally, "an upstream", "a downstream" and terms similar to these respectively show "an upstream", "a downstream" and concept similar to these in the conveying direction of the sheet S. The terms showing these directions are used for convenience of explanation, and does not limit the technical scope of the present disclosure.

With reference to FIG. 1, an entire structure of an image forming apparatus 1 will be described. FIG. 1 is a sectional view schematically showing an inner structure of the image forming apparatus 1.

The image forming apparatus 1 is provided with a printing device 1A and a scanning device 1B. The printing device 1A is an inkjet type printer which ejects an ink drop from each inkjet head 22A to form an image on the sheet S. The scanning device 1B is a device arranged on an upper face of the printing device 1A and optically reading an image data of a document. The scanning device 1B has a well-known structure, and its detail explanation is omitted.

[The printing device] The printing device 1A includes an apparatus main body 2 constituting an approximately parallelepiped appearance. In a lower portion of an inside of the apparatus main body 2, four sheet feeding cassettes 3 are detachably provided. The four sheet feeding cassettes 3 store the sheets S (a bundle of sheets S) having different sizes. In a center portion of the apparatus main body 2 in the upper-and-lower direction, a manual bypass tray 4 on which the sheet S (a bundle of sheet S) is placed is provided. The manual bypass tray 4 extends in the right oblique direction from a right side face of the apparatus main body 2. In an upper portion of the apparatus main body 2, a first ejected sheet tray 5 and a second ejected sheet tray 6 are provided. The first ejected sheet tray 5 extends in the left oblique direction from a left side face of the apparatus main body 2. The second ejected sheet tray 6 extends in the right oblique direction from the right side face (a right upper corner portion) of the apparatus main body 2. The sheet S is not limited to a paper sheet, and may be a film made of resin.

Inside the apparatus main body 2, a feeding conveying path 10, a manual bypass conveying path 11, a first conveying path 12, a second conveying path 13, a first ejecting conveying path 14 and a second ejecting conveying path 15 are formed as a conveying path along which the sheet S is conveyed.

The feeding conveying path 10 extends from the four sheet feeding cassettes 3 to the upstream side of a resist roller pair 31 (described later). The manual bypass conveying path 11 extends from the manual bypass tray 4 to the downstream side of the feeding conveying path 10. The first conveying path 12 extends from the downstream side of the resist roller pair 31 to near a left side wall of the apparatus main body 2. The second conveying path 13 is formed so as to communicate a downstream side end and an upstream side end of the first conveying path 12. The first and second conveying paths 12 and 13 are entirely formed in an annular shape around an image forming part 22 (described later). The first ejecting conveying path 14 extends from the downstream end of the first conveying path 12 to the first ejected sheet tray 5. The second ejecting conveying path 15 extends from the downstream side of the first conveying path 12 to the second ejected sheet tray 6.

The second conveying path 13 includes a circulation path 13A, a switchback path 13B and a re-conveying path 13C. The circulation path 13A is folded back upward from the downstream end of the first conveying path 12, and then extends to the upstream end of the second ejecting conveying path 15. The switchback path 13B is folded back downward from the downstream end of the second conveying path 13, and then extends to the left direction. The re-conveying path 13C is branched from the switchback path 13B, folded back downward, and then extends to the upstream end of the first conveying path 12.

The printing device 1A includes four cassette feeding parts 20, a manual bypass feeding part 21, the image forming part 22, a first conveying part 23 and a second conveying part 24, which are provided inside the apparatus main body 2.

Each of the four cassette feeding parts 20 is provided near each sheet feeding cassette 3, separates the sheet S in the sheet feeding cassette 3 one by one and then feeds the sheet S to the feeding conveying path 10. On the upstream side portion of the feeding conveying path 10, a plurality of (for example, four) first feed roller pairs 26 are arranged at predetermined intervals. On the downstream side portion of the feeding conveying path 10, a plurality of (for example, three) second feed roller pairs 27 are arranged at predetermined intervals. The first and second feed roller pairs 26 and 27 grip the sheet S and then rotate to feed the sheet S to the downstream side. The manual bypass feeding part 21 is provided near the manual bypass tray 4, separates the sheet S placed on the manual bypass tray 4 one by one and then feeds the sheet S to the manual bypass conveying path 11.

The image forming part 22 is a device which forms an image on the sheet S, and includes four inkjet heads 22A mounted on a carriage (not shown), for example. The four inkjet heads 22A are aligned in the left-and-right direction, and connected to corresponding ink tanks 25. The four ink tanks 25 are arranged at the left side portion of the inside of the apparatus main body 2, and store ink of four colors (yellow, magenta, black and cyan) respectively. On a lower face of each inkjet head 22A, a plurality of nozzles (not shown) which eject an ink drop to the sheet S conveyed along the first conveying path 12 are formed.

The first conveying part 23 includes the resist roller pair 31, a print conveying belt 32, a dry conveying belt 33 and a first de-curler 34.

The resist roller pair 31 is arranged at the upstream end portion of the first conveying path 12 (at the upstream side of the image forming part 22). The resist roller pair 31 adjusts a timing when the sheet S is conveyed to the image forming part 22.

The print conveying belt 32 is arranged opposite to the lower face of each inkjet head 22A on the first conveying path 12. The dry conveying belt 33 is arranged at the downstream side of the print conveying belt 32 on the first conveying path 12. Each of the conveying belts 32 and 33 is an endless belt bridged between a plurality of rollers, and is driven to be rotated in a direction shown by an arrow in FIG. 1. Each of the conveying belts 32 and has a plurality of suction openings (not shown) communicating with a suction device. When the suction device is driven, the sheet S is conveyed while sucked on an upper face of each of the conveying belts 32 and 33. The first de-curler 34 is arranged at the downstream side of the dry conveying belt 33 on the first conveying path 12, and corrects a curl of the sheet S on which the image is formed.

The second conveying part 24 includes a plurality of ejection conveying roller pairs 35, a second de-curler 36, a both-side conveying roller pair 37, an inverse roller pair 38 and a re-conveying roller pair 39.

The plurality of ejection conveying roller pairs are arranged along the circulation path 13A at predetermined intervals. The second de-curler 36 is arranged on the downstream end portion of the circulation path 13A, and corrects a curl of the sheet S on which the image is formed. The both-side conveying roller pair 37 is arranged on the upstream side end portion of the switchback path 13B. The inverse roller pair 38 is arranged at the downstream side of the curved portion of the switchback path 13B. The re-conveying roller pair 39 is provided on the curved portion of the re-conveying path 13C. The roller pairs 35, 37, 38 and 39 grip the sheet S, and then rotate to feed the sheet S to the downstream side.

[An operation of the image forming apparatus] The operation of the image forming apparatus 1 (an image forming process) will be described. The above described each device (structure) of the image forming apparatus 1 is controlled by a control device (not shown) to perform the following image forming process. One sheet S is fed from one sheet feeding cassette 3.

The cassette feeding part 20 feeds the sheet S in the sheet feeding cassette 3 to the feeding conveying path 10. The sheet S conveyed along the feeding conveying path 10 is butted against the stopped resist roller pair 31. This deflects the sheet S to correct the skew of the sheet S.

The resist roller pair 31 feeds the sheet S whose skew is corrected, to the first conveying path 12 synchronously with a timing at which the ink drop is ejected. Each inkjet head 22A ejects the ink drop on one face of the sheet S sucked and conveyed by the print conveying belt 32 and forms an image. The conveying belts 32 and 33 and the first de-curler 34 feed the sheet S, on one face of which the image is formed, from the first conveying path 12 to the first ejecting conveying path 14, and then eject the sheet S on the first ejected sheet tray 5. When the sheet S on one face of which the image is formed is inversed and then ejected, the plurality of ejection conveying roller pairs 35 and the second de-curler 36 feed the sheet S from the circulation path 13A to the second ejecting conveying path 15, and then eject the sheet S on the second ejected sheet tray 6.

On the other hand, when the both-side printing is performed, the sheet S is conveyed from the circulation path 13A to the switchback path 13B. The both-side conveying roller pair 37 and the inverse roller pair 38 convey the sheet S to the downstream side of the switchback path 13B, and the inverse roller pair 38 stops the sheet S entered the straight portion of the switchback path 13B temporarily. The inverse roller pair 38 is driven to be rotated inversely, and feeds the sheet S from the switchback path 13B to the re-conveying path 13C to inverse the sheet S. The re-conveying roller pair 39 feeds the sheet S conveyed to the re-conveying path 13C toward the first conveying path 12 again.

The skew of the sheet S is corrected by the resist roller pair 31, and then the sheet S is fed to the first conveying path 12 synchronously with a timing at which the ink drop is ejected. Then, by the same processes as the described above process, an image is formed on the other face (the back face) of the sheet S. The sheet S on both faces of which the images are formed is ejected on the first ejected sheet tray 5 or the second ejected sheet tray 6.

The image forming apparatus 1 is configured such that a conveying failure of the sheet S (a paper jam) is detected by using a detection device arranged on the feeding conveying path 10, the first and second conveying paths 12 and 13 and the others. When the paper jam is occurred, the control device stops the image forming operation, and displays a message showing the occurrence of the paper jam on a liquid crystal panel or the like (not shown). The image forming apparatus 1 of the present embodiment is provided with a jam treatment structure 28 capable of treating the paper jam by a user.

Figure 2:
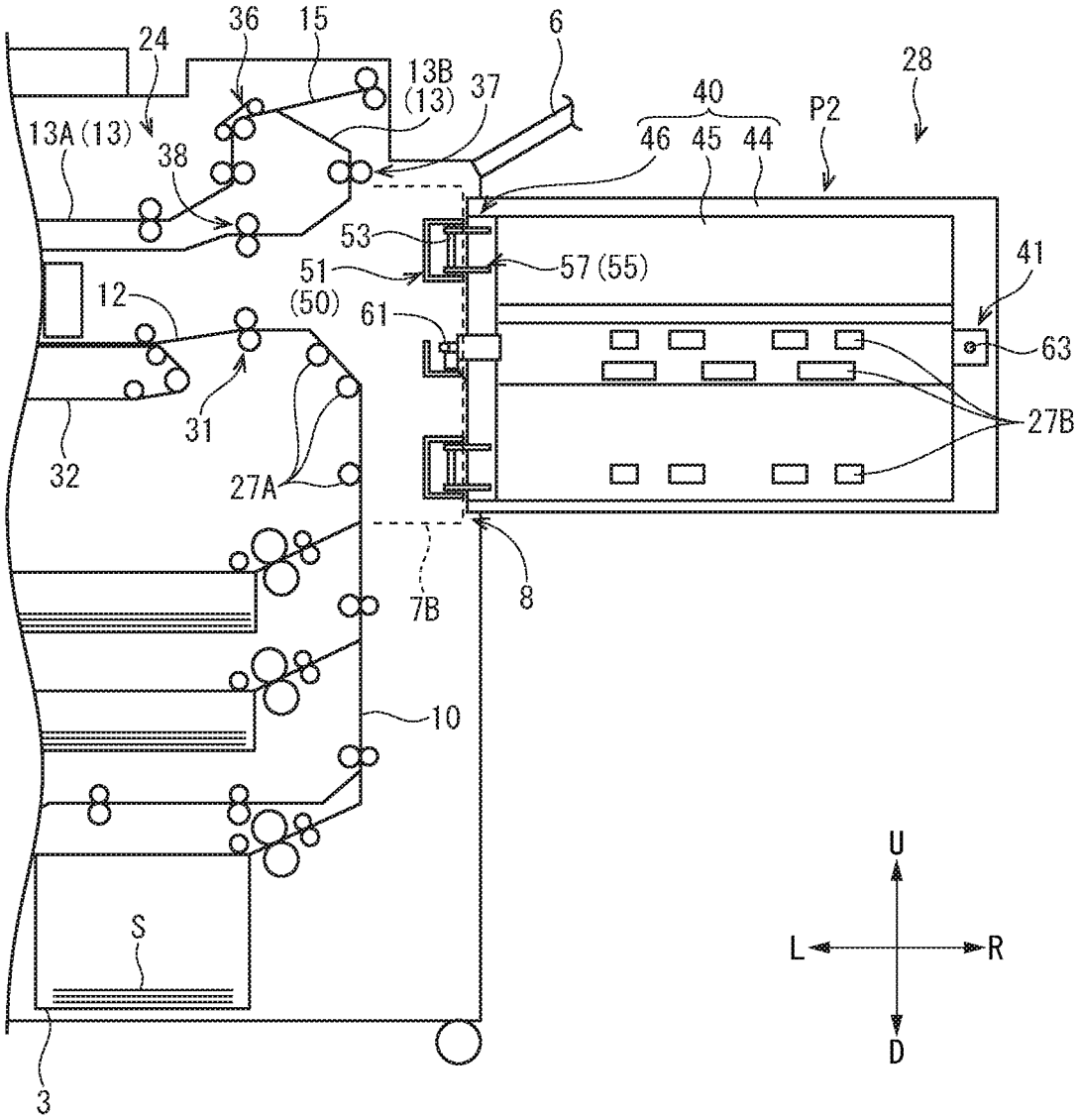
FIG. 2 is a front view showing the image forming apparatus, in a state where an opening and closing door is opened, according to the embodiment of the present disclosure.
Figure 3:
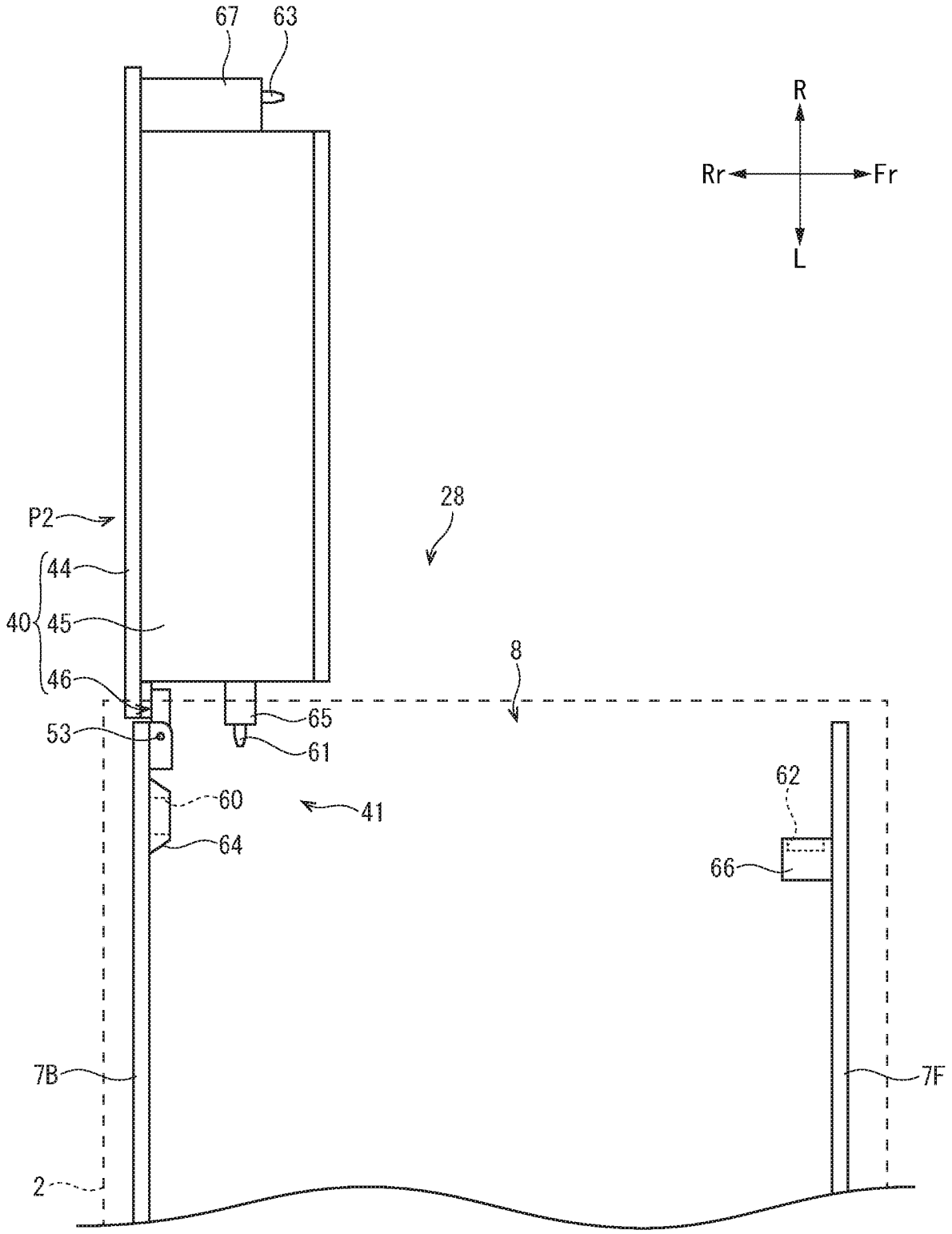
FIG. 3 is a plan view showing a jam treatment structure in the state where the opening and closing door is opened, in the image forming apparatus according to the embodiment of the present disclosure.
Figure 4:
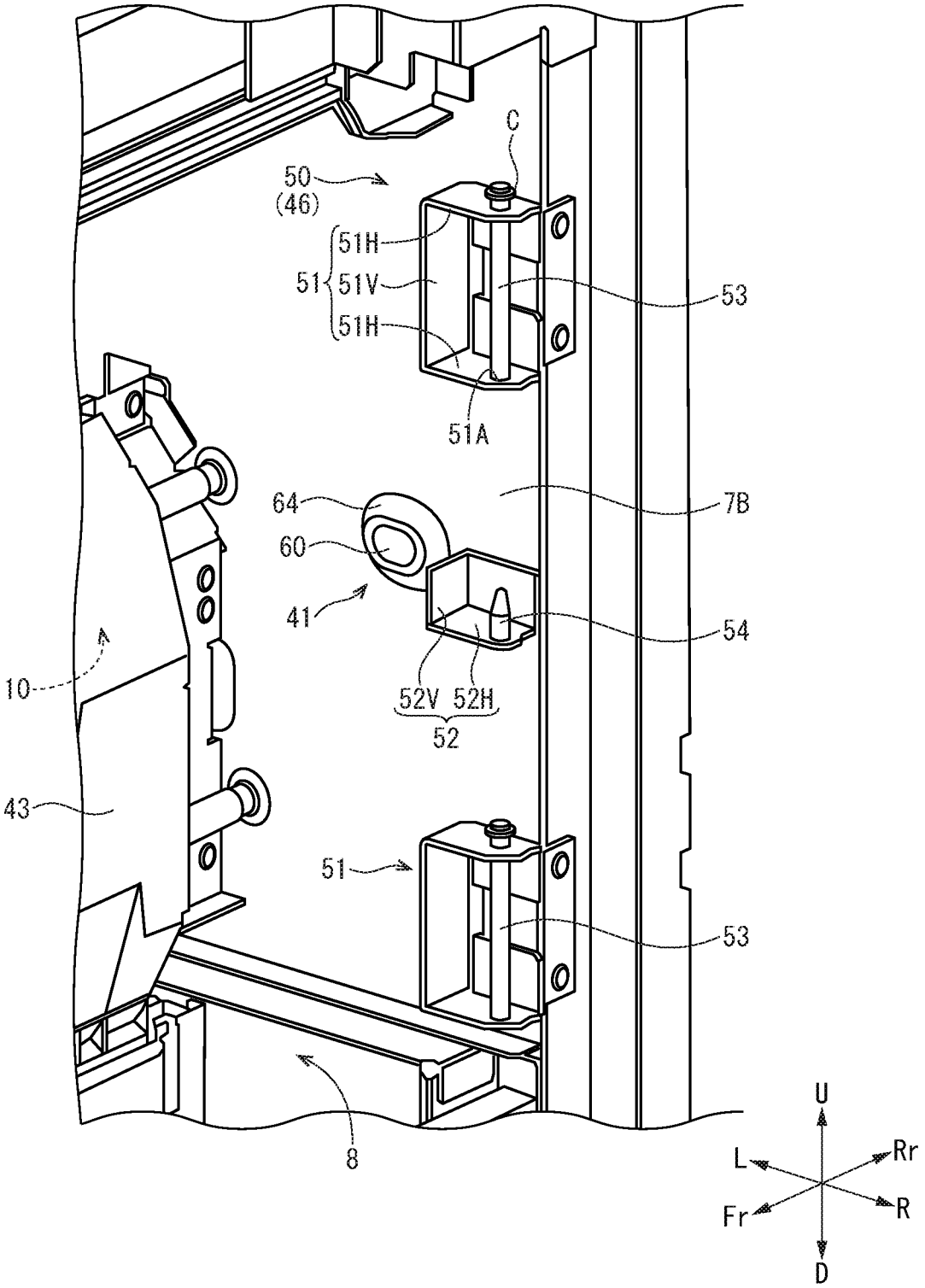
FIG. 4 is a perspective view showing a part of a rear support frame of the image forming apparatus according to the embodiment of the present disclosure.
Figure 5:
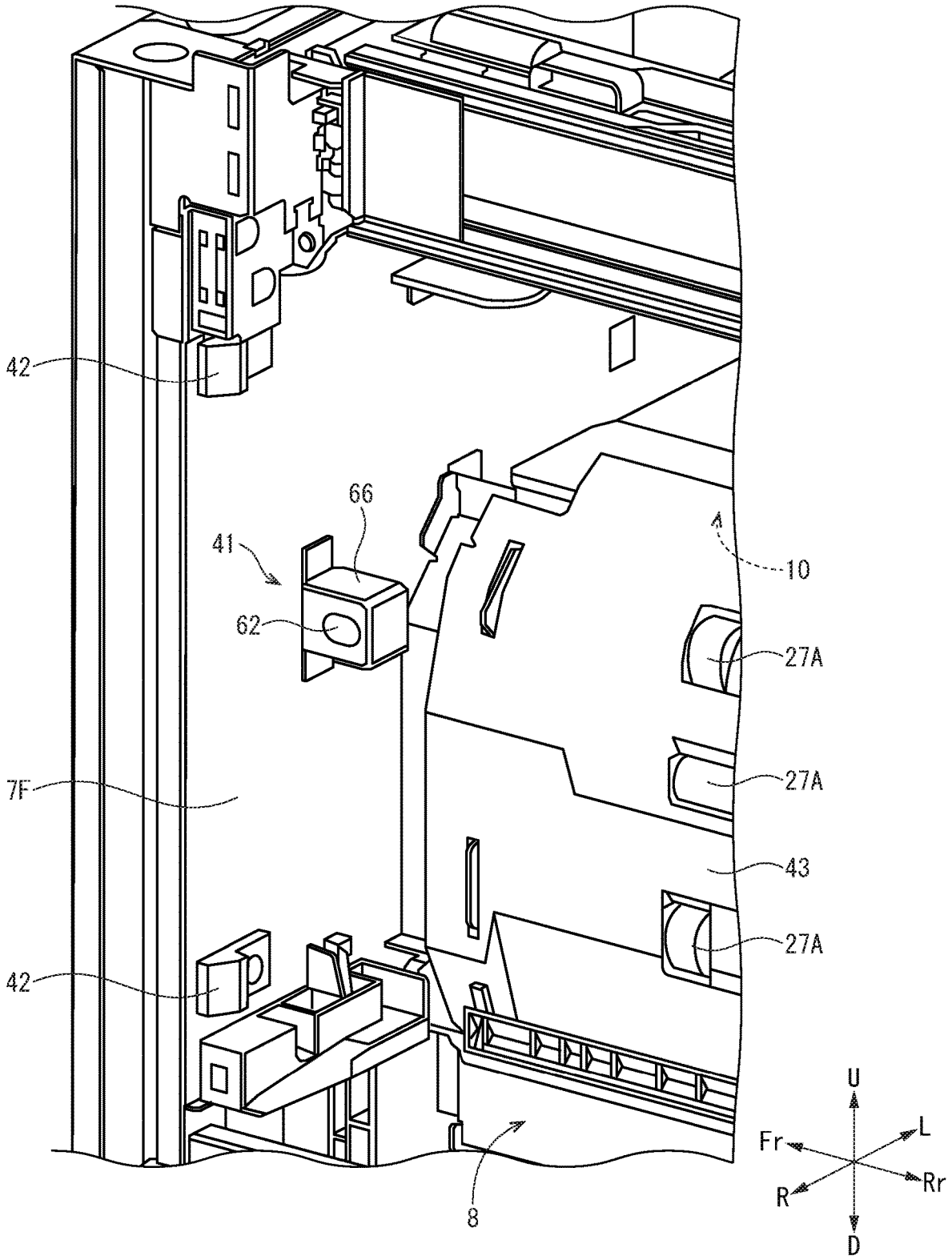
FIG. 5 is a perspective view showing a part of a front support frame of the image forming apparatus according to the embodiment of the present disclosure.
Figure 6:
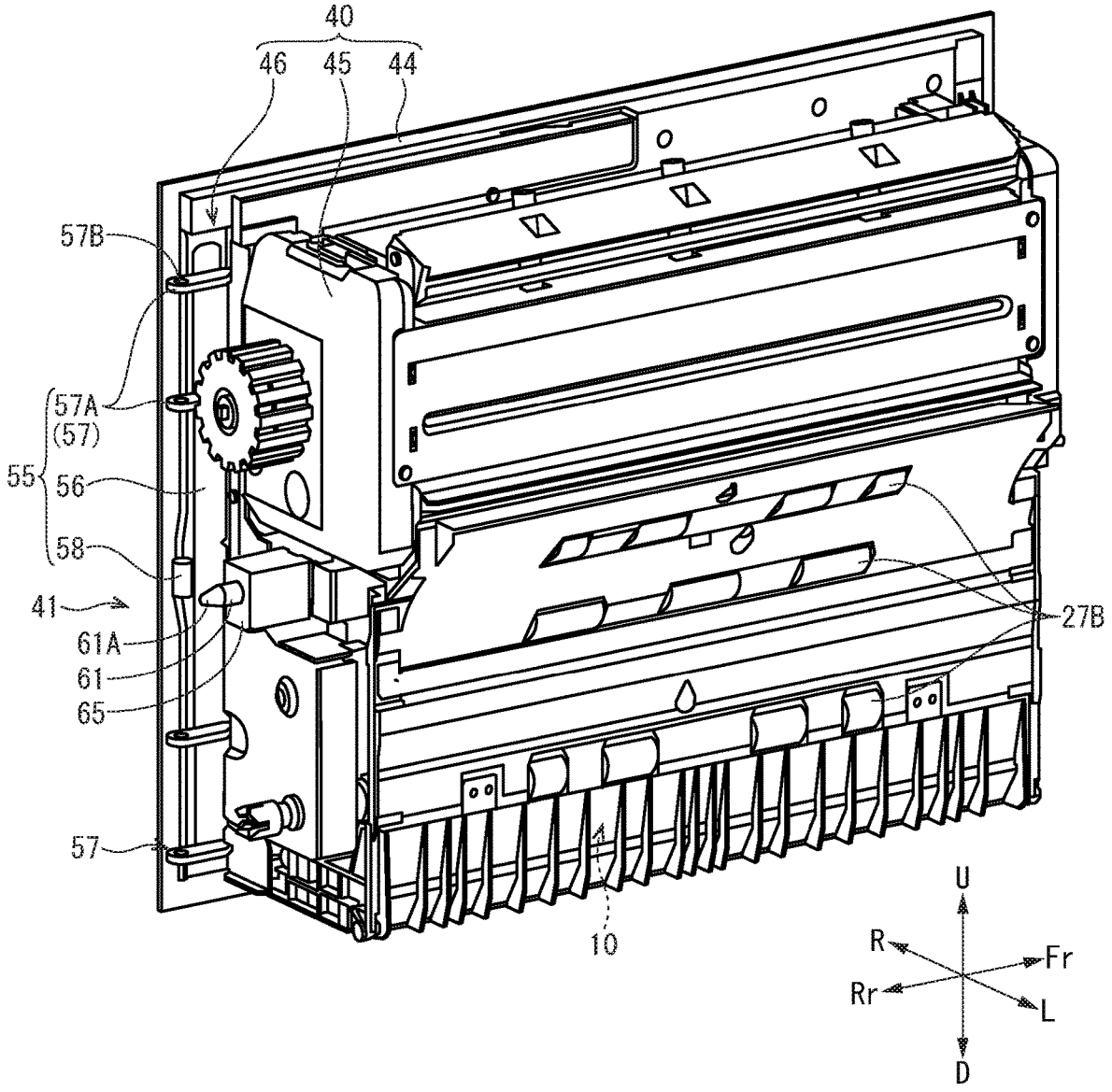
FIG. 6 is a perspective view showing a rear portion of the opening and closing door of the image forming apparatus according to the embodiment of the present disclosure.
Figure 7:
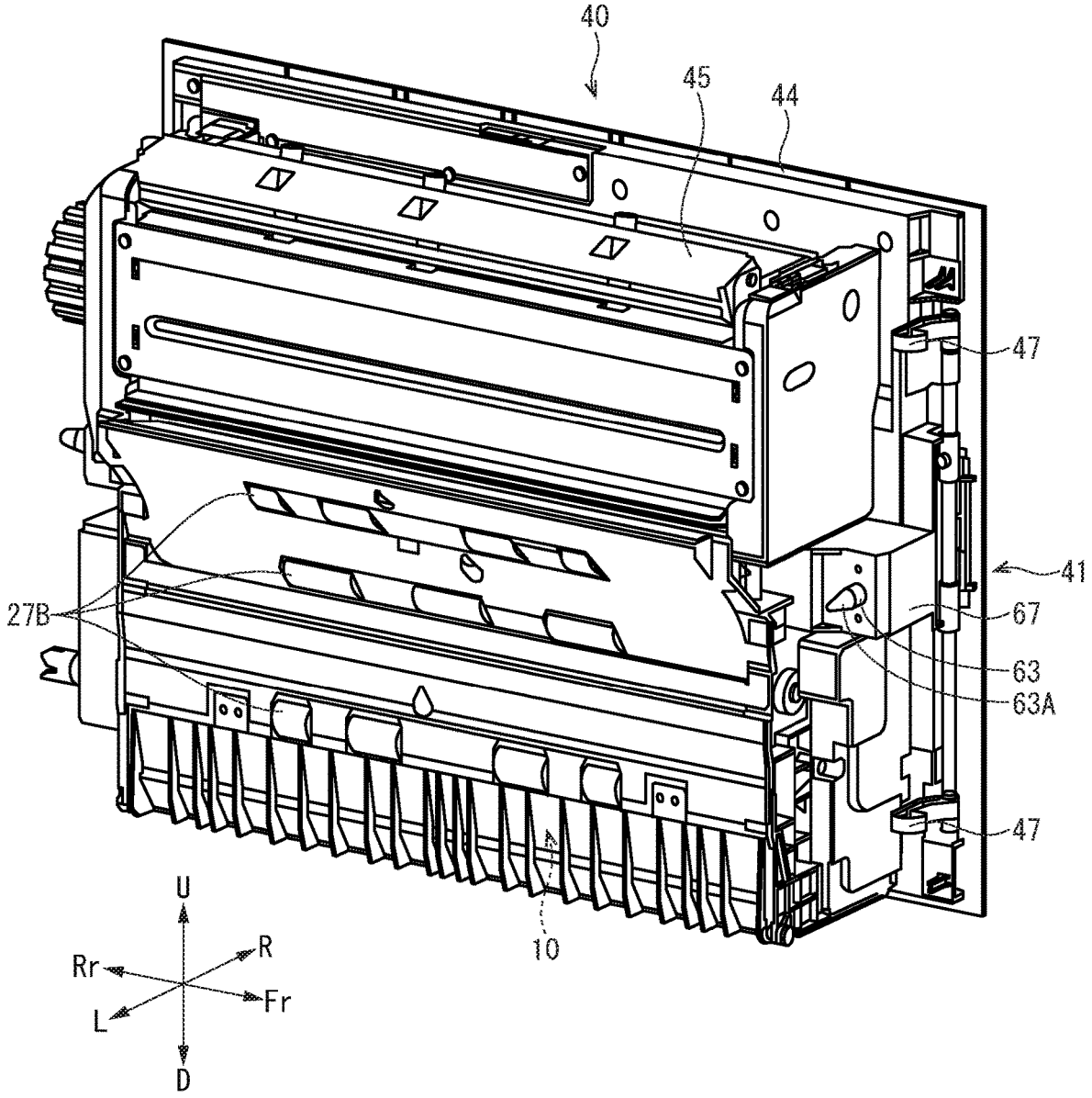
FIG. 7 is a perspective view showing a front portion of the opening and closing door of the image forming apparatus according to the embodiment of the present disclosure.

[The jam treatment structure] With reference to FIG. 2 to FIG. 7, the jam treatment structure 28 will be described. FIG. 2 is a front view schematically showing an opened opening and closing door 40. FIG. 3 is a plan view schematically showing the opened opening and closing door 40. FIG. 4 is a perspective view showing a part of a rear support frame 7B of the image forming apparatus 1. FIG. 5 is a perspective view showing a part of a front support frame 7F of the image forming apparatus 1. FIG. 6 is a perspective view showing a rear portion of the opening and closing door 40. FIG. 7 is a perspective view showing a front portion of the opening and closing door 40.

As shown in FIG. 2 and FIG. 3, the jam treatment structure 28 includes a pair of support frames 7F and 7B, an opening and closing door 40 and a positioning structure 41. The jam treatment structure 28 is provided to remove the sheet S jammed near the resist roller pair 31, for example.

<The support frame> As shown in FIG. 2 to FIG. 5, the pair of support frames 7F and 7B are made of a metal plate, for example, and are provided with an interval in the front-and-rear direction (an opposite direction) in an upright posture. On outer faces of the pair of support frames 7F and 7B, exterior walls (not shown) made of synthetic resin are fixed, for example. That is, the apparatus main body 2 contains the pair of support frames 7F and 7B and the exterior walls. The pair of support frames 7F and 7B constitute a main framework of the apparatus main body 2. On a right end portion of the front support frame 7F, a pair of upper and lower main body side hooks 42 are fixed (refer to FIG. 5).

The pair of support frames 7F and 7B are oppositely arranged on both sides of an opening 8 opened at an upper portion of the right side face of the apparatus main body 2 (the exterior wall). The opening 8 is formed in an approximately rectangular shape in a side view. The pair of support frames 7F and 7B are oppositely arranged on both sides of the above image forming part 22, the conveying parts 23 and 24, the conveying paths 10 to 15 and the others (refer to FIG. 1).

As shown in FIG. 4 and FIG. 5, between the pair of support frames 7F and 7B, a conveying face part 43 is provided. The conveying face part 43 is arranged at the side of the opening 8 (the right side) of each of the support frames 7F and 7B, and forms a part (one face) of the feeding conveying path 10. On the conveying face part 43, main body side rollers 27A of three second feed roller pairs 27 are supported in a rotatable manner. Each main body side roller 27A includes a roller shaft extending in the front-and-rear direction and a plurality of rollers fixed to the roller shaft. The roller shaft of each main body side roller 27A is supported by the conveying face part 43 with the rollers exposed to the surface of the conveying face part 43. Each main body side roller 27A is connected to a drive motor (not shown) via a gear train, and driven by the drive motor to be rotated.

<The opening and closing door> As shown in FIG. 2 and FIG. 3, the opening and closing door 40 is supported by the rear support frame 7B via a turning shaft 53 (described later) extending in the upper-and-rear direction. The opening and closing door 40 is turned around the turning shaft 53 between a closing position P1 (refer to FIG. 1) where it closes the opening 8 to form a part (the downstream side portion) of the feeding conveying path 10 and an opening position P2 (refer to FIG. 2 and the others) where it opens the opening 8. In the following description, it is described based on a state where the opening and closing door 40 is turned to the closing position P1.

The opening and closing door 40 includes an exterior cover 44, an opening and closing conveying part 45 and a hinge part 46.

As shown in FIG. 2, FIG. 3, FIG. 6 and FIG. 7, the exterior cover 44 is made of synthetic resin, for example, and is formed in an approximately rectangular plate shape. The exterior cover 44 constitutes a part of the right side face of the exterior wall. On the exterior cover 44, the manual bypass tray 4 (refer to FIG. 1) is supported in a turnable manner. At an front end portion of the exterior cover 44, a pair of upper and lower door side hooks 47 are provided (refer to FIG. 7). With the pair of door side hooks 47, the pair of main body side hooks 42 (refer to FIG. 5) fixed to the front support frame 7F are engaged. This holds the opening and closing door 40 at the closing position P1. On an outer face of the exterior cover 44, a release handle (not shown) is provided, which turns each door side hook 47 to release the engagement of each main body side hook 42 with each door side hook 47.

The opening and closing conveying part 45 is formed in an approximately parallelepiped rectangular shape, and is fixed to an inner face of the exterior cover 44. Inside the opening and closing conveying part 45, a part of the manual bypass conveying path 11 and the re-conveying path 13C are formed (refer to FIG. 1). In the state where the opening and closing door 40 is turned to the closing position P1, a lower portion of an inner face of the opening and closing conveying part 45 is arranged opposite to the conveying face part 43 with an interval. That is, between the opening and closing conveying part 45 (the opening and closing door 40) arranged at the closing position P1 and the conveying face part 43, a part (the downstream side portion) of the feeding conveying path 10 is formed. Inside the opening and closing conveying art 45, the manual bypass feeding part 21, the re-conveying roller pair 39 and the others are provided (refer to FIG. 1).

As shown in FIG. 6 and FIG. 7, on the opening and closing conveying part 45, opposite rollers 27B of the three second feed roller pairs 27 are supported in a rotatable manner. Each opposite roller 27B includes a roller shaft extending in the front-and-rear direction and a plurality of rollers fixed to the roller shaft. The roller shaft of each opposite roller 27B is supported by the opening and closing conveying part 45 with the roller exposed to the lower portion of the inner face of the opening and closing conveying part 45. Each opposite roller 27B is pressed against the main body side roller 27A in the state where the opening and closing door 40 is turned to the closing position P1, and is driven by the main body side roller 27A to be rotated.

As shown in FIG. 2, the hinge part 46 includes a main body side hinge part 50 and a door side hinge part 55. The main body side hinge part 50 and the door side hinge part 55 are made of metal, such as iron and stainless steel.

As shown in FIG. 4, the main body side hinge part 50 is fixed to the right end portion of the rear support frame 7B. The main body side hinge part 50 includes a pair of upper and lower shaft support brackets 51 and a middle bracket 52. Each shaft support bracket 51 is formed in an approximately U-shape, and has a vertical plate 51V and a pair of horizontal plates 51H extending rightward from upper and lower edges of the vertical plate 51V. Each horizontal plate 51H has an axial hole 51A through which the approximately columnar turning shaft 53 penetrates in the upper-and-lower direction. The middle bracket 52 is arranged between the pair of shaft support brackets 51. The middle bracket 52 is formed in an approximately L-shape, and has a vertical plate 52V and a horizontal plate 52H extending rightward from a lower edge of the vertical plate 52V. On the horizontal plate 52H of the middle bracket 52, an approximately columnar boss 54 is stood. An upper end portion of the boss 54 is formed to be tapered.

As shown in FIG. 6, the door side hinge part 55 includes a main plate 56, a pair of upper and lower support arms 57 and a middle sleeve 58. The main plate 56 is formed in a rectangular shape elongated in the upper-and-lower direction, and is fixed to the rear end portion of the exterior door 44. The upper and lower support arms 57 are fixed to the main plate 56 at a position corresponding to the upper and lower shaft support brackets 51. Each support arm 57 is formed by a pair of arm pieces 57A separating each other in the upper-and-lower direction. A distance between the pair of arm pieces 57A is shorter than a distance between the pair of horizontal plates 51H of the shaft support bracket 51. Each arm piece 57A is formed in a state extending almost horizontally from the main plate 56. A base portion of each arm piece 57A is fixed to the main plate 56, and a tip portion of each arm piece 57A is positioned at the rear side of the main plate 56. At the tip portion of each arm piece 57A, an axial hole 57B is formed, through which the turning shaft 53 penetrates. The middle sleeve 58 is fixed to the main plate 56 at a position corresponding to the boss 54 of the middle bracket 52. The middle sleeve 58 is formed in an approximately cylindrical shape into which the boss 54 can be inserted.

The boss 54 of the middle bracket 52 is fitted into the middle sleeve 58, and each support arm 57 is arranged inside the corresponding shaft support bracket 51 (refer to FIG. 2). The turning shaft 53 is inserted into the axial hole 51A of the shaft support bracket 51 and the axial hole 57B of the support arm 57. In a state where the turning shaft 53 penetrates through the shaft support bracket 51 and the support arm 57 in the upper-and-lower direction, stop rings C (refer to FIG. 4) are attached to the upper and lower end portions of the turning shaft 53. As described above, the opening and closing door 40 is supported by the rear support frame 7B in a turnable manner around the turning shaft 53. In addition, in the state, the opening and closing door 40 is movable along the upper-and-lower direction along the turning shaft 53 extending in the upper-and-lower direction by several millimeters.

<The positioning structure> The positioning structure 41 engages concave parts provided in the pair of support frames 7F and 7B with convex parts provided in both end portions of the opening and closing door 40 each other in the state where the opening and closing door 40 is turned to the closing position P1, and positions the opening and closing door 40 to the pair of support frames 7F and 7B. In detail, as shown in FIG. 3 to FIG. 7, the positioning structure 41 includes a first concave part 60, a first convex part 61, a second concave part 62 and a second convex part 63.

As shown in FIG. 3 and FIG. 4, the first concave part 60 is provided at a right side portion of the rear support frame 7B (one of the support frames). In detail, the first concave part 60 is provided at a protruded portion 64 formed near the left side of the middle bracket 52. The protruded portion 64 protrudes forward from the inner face of the support frame 7B. The protruded portion 64 is formed in an approximately long circular shape elongated in the left-and-right direction in the front view and in an approximately trapezoidal shape tapered to the tip end in the side view. The protruded portion 64 is formed by subjecting the support frame 7B (the metal plate) to drawing processing, for example. The first concave part 60 is a through hole formed at the tip end face of the protruded portion 64 by burring processing, for example. The first concave part 60 is formed at a tip face of. The first concave part 60 is formed in an approximately long circular hole elongated in the left-and-right direction (a width direction perpendicular to the opposite direction and the upper-and-lower direction). The first concave part 60 is opened to the front side.

As shown in FIG. 3 and FIG. 6, the first convex part 61 is provided at the side of the turning shaft 53 (a suspended base side) of the opening and closing door 40 at a position corresponding to the first concave part 60. In detail, the first convex part 61 is provided in a first support base 65 fixed on the rear end face of the opening and closing conveying part 45 near the left side of the middle sleeve 58. The first support base 65 is made of metal, and is formed in an approximately parallelepiped rectangular shape. The first support base 65 protrudes rearward from the rear end face of the opening and closing conveying part 45. The first convex part 61 is made of metal or resin, and is formed in an approximately columnar shape, for example. A diameter of the first convex part 61 is slightly smaller than an inner diameter (a distance) of the first concave part 60 in the upper-and-lower direction. At a tip end portion of the first convex part 61, an approximately conical shaped first tapered portion 61A is formed. A base end portion of the first convex part 61 is fixed to the tip end face of the first support base 65. The first convex part 61 protrudes rearward from the tip end face of the first support base 65. The first convex part 61 is protruded in a direction perpendicular to an axial direction (the upper-and-lower direction) of the turning shaft 53. Furthermore, the first convex part 61 is provided so as not to protrude from the opening and closing conveying part 45 toward the conveying face part 43 outside (on the rear side of) the opening and closing conveying part 45.

As shown in FIG. 3 and FIG. 5, the second concave part 62 is provided at the right side portion of the front support frame 7F (the other of the support frames). In detail, the second concave part 62 is provided at a door stop part 66 fixed on the approximately center portion in the upper-and-lower direction of the front side face of the opening 8. The door stop part 66 is made of metal, and is formed in an approximately parallelepiped hollow shape, for example. The door stop part 66 protrudes rearward from the inner face of the front support frame 7F. The second concave part 62 is opened to the right side face of the door stop part 66. The second concave part 62 is formed in an approximately long hole elongated in the front-and-rear direction. The second concave part 62 is opened to the right side. That is, the first concave part 60 and the second concave part 62 are opened in directions perpendicular to each other.

As shown in FIG. 3 and FIG. 7, the second convex part 63 is provided at an opposite side (the near side) of the turning shaft 53 of the opening and closing door 40 at a position corresponding to the second concave part 62. In detail, the second concave part 63 is provided at a second support base 67 fixed to the approximately center portion in the upper-and-lower direction of the front end face of the opening and closing conveying part 45. The second support base 67 is made of metal, and is formed in an approximately parallelepiped rectangular shape, for example. The second support base 67 protrudes forward from the front end face of the opening and closing conveying part 45. The second convex part 63 is made of metal or resin, and is formed in an approximately columnar shape, for example. A diameter of the second convex part 63 is slightly smaller than an inner diameter (a distance) of the second concave part 62 in the upper-and-lower direction. At the tip end portion of the second convex part 63, an approximately conical shaped second tapered portion 63A is formed. The base end portion of the second convex part 63 is fixed to the left side face of the second support base 67. The second convex part 63 protrudes leftward from the left side face of the second support base 67. The second convex part is protruded in a direction perpendicular to the protruding direction of the first convex part 61. Furthermore, the second convex part 63 is protruded in a direction perpendicular to the axial direction (the upper-and-lower direction) of the turning shaft 53. Furthermore, the second convex part 63 is provided so as not to protrude from the opening and closing conveying part 45 toward the conveying face part 43 outside (on the front side of) the opening and closing conveying part 45.

Figure 8:
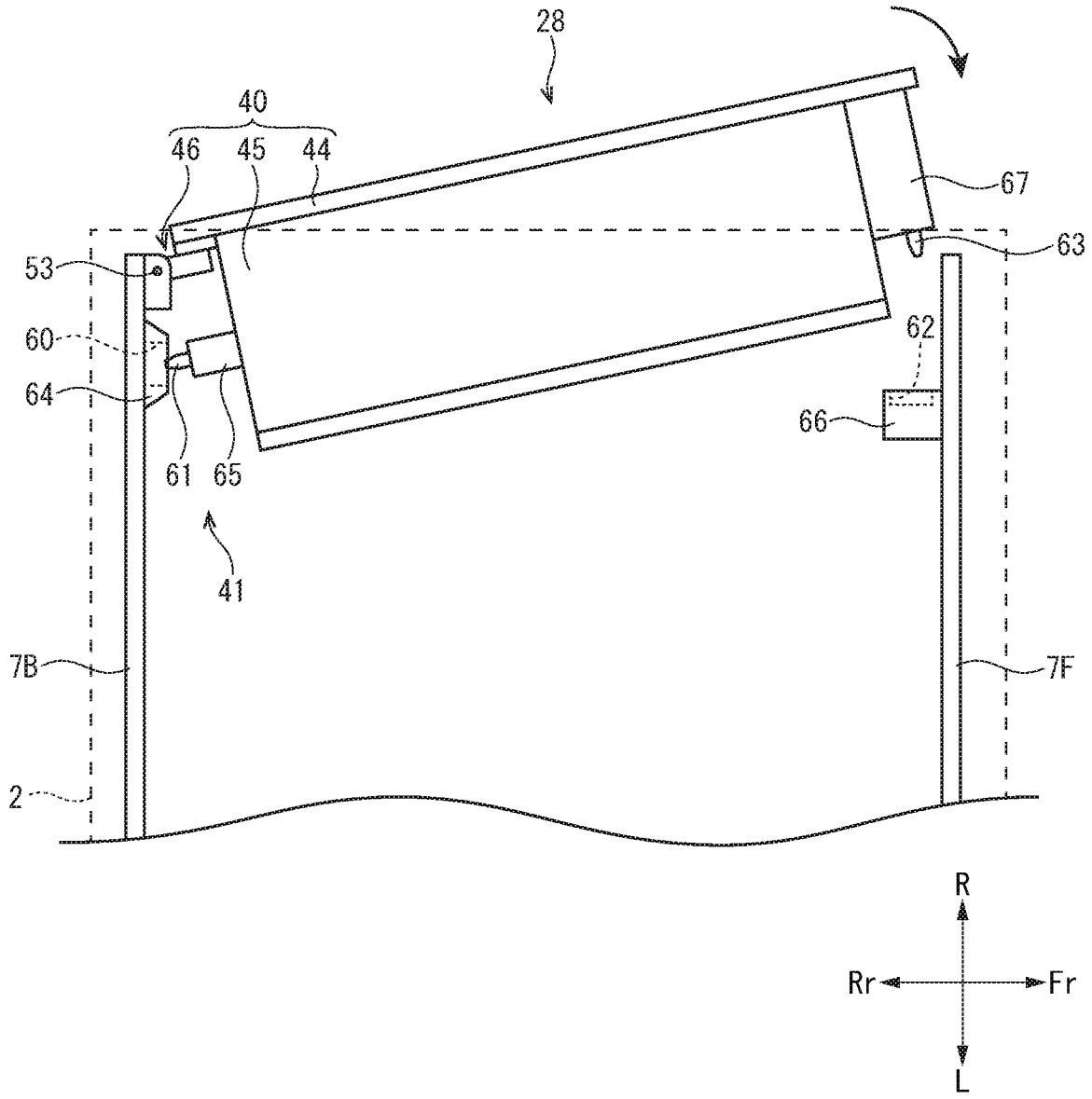
FIG. 8 is a plan view showing the jam treatment structure in a process where the opening and closing door is closed, in the image forming apparatus according to the embodiment of the present disclosure.
Figure 9:
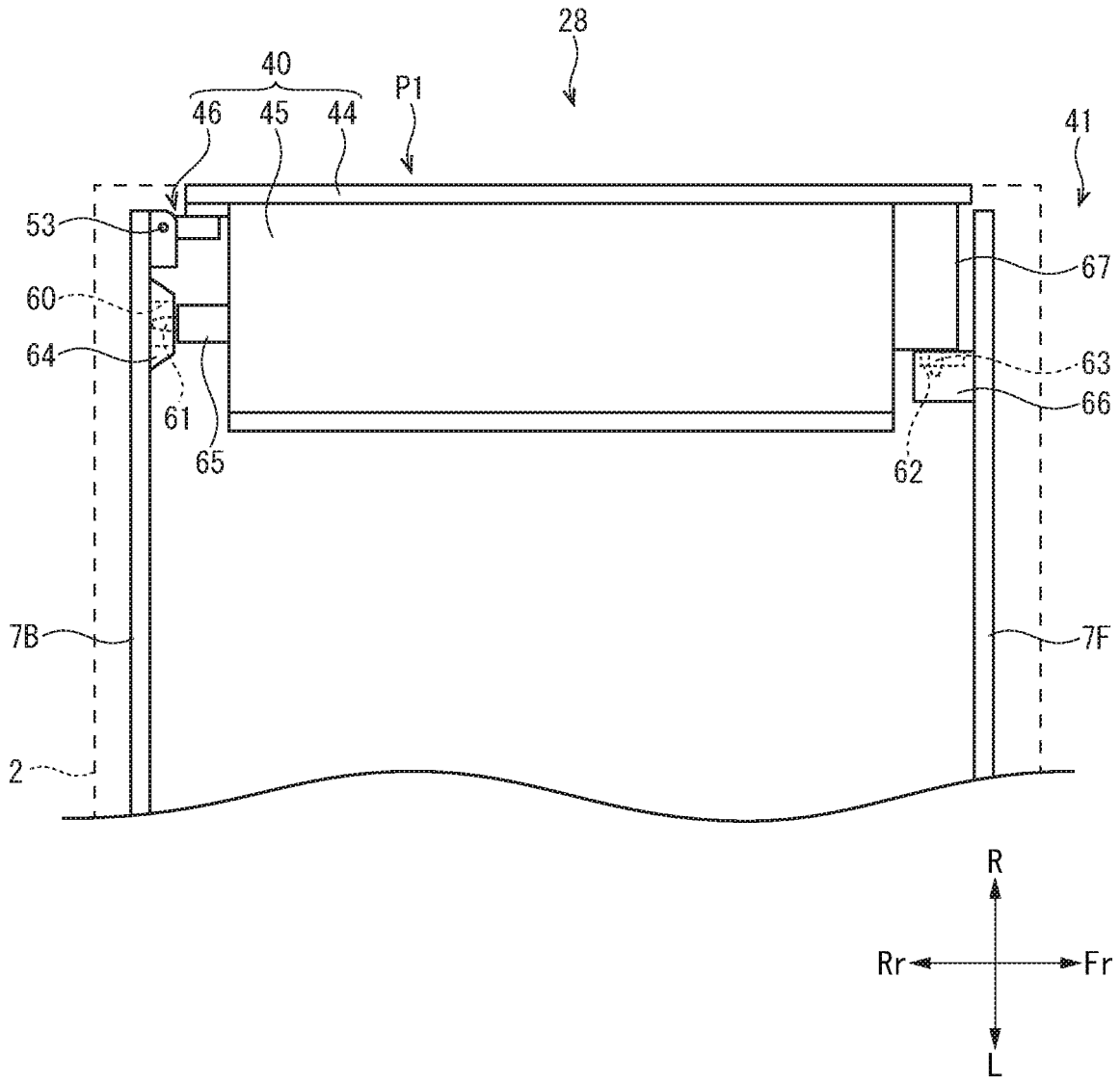
FIG. 9 is a plan view showing the jam treatment structure in the state where the opening and closing door is closed, in the image forming apparatus according to the embodiment of the present disclosure.

[An operation of the jam treatment structure] Next, with reference to FIG. 3, FIG. 8 and FIG. 9, the operation of the jam treatment structure 28 will be described. FIG. 8 is a plan view schematically showing the opening and closing door 40 in a process where it is closed. FIG. 9 is a plan view showing the closed opening and closing door 40.

<A case where the opening and closing door is opened> For example, when the sheet S is jammed at the resist roller pair 31 (the jam is occurred), a user operates the release handle of the exterior cover 44 to unlock the opening and closing door 40, and turns the opening and closing door 40 outside around the turning shaft 53. Then, as shown in FIG. 3, the opening and closing door 40 is turned from the closing position P1 to the opening position P2. When the opening and closing door 40 is turned to the opening position P2, almost the whole of the opening 8 is opened, and the downstream side portion of the feeding conveying path 10 (the upstream side of the resist roller pair 31) is exposed. As a result, the user can remove the jammed sheet S. A turning angle of the opening and closing door 40 is set to be about 90°, for example. That is, the opening and closing door 40 is openable in a posture where it is perpendicular to the opening face of the opening 8. By opening the opening and closing door 40 widely in the above manner, the user can remove the jammed sheet S easily.

If the opening and closing door 40 is turned around the lower side as a turning axis and held in an inclined posture, because the turning axis side portion of the opening and closing door 40 is not opened sufficiently, a user's visibility at the jam treatment may be deteriorated. However, in the image forming apparatus 1 of the present embodiment, because the opening and closing door 40 is turned around the turning shaft 53 extending in the upper-and-lower direction at the rear portion of the apparatus main body 2 by about 90°, it becomes possible to open the whole of the opening 8. This can improve the user's visibility at the jam treatment.

The opening and closing door 40 turned to the opening position P2 is slightly lowered along the turning shaft by its own weight. In detail, the lower end of the support arm 57 (refer to FIG. 6) of the door side hinge part 55 is butted against the horizontal plate 51H (refer to FIG. 4) of the shaft support bracket 51 of the main body side hinge part 50, and the middle sleeve (refer to FIG. 6) of the door side hinge part 55 is butted against the horizontal plate 52H (refer to FIG. 4) of the middle bracket 52 of the main body side hinge part 50. The tip side of the opening and closing door 40 is hung down lower than the suspended base side.

<A case where the opening and closing door is closed> After the jam treatment is completed, the user turns the opening and closing door 40 from the opening position P2 to the closing position P1. As shown in FIG. 8, when the opening and closing door 40 is turned, the tip end portion of the first convex portion 61 provided at the suspended base side of the opening and closing door 40 begins to enter the first concave part 60. In detail, the first convex part 61 enters the first concave part 60 along a circular orbit from the left side to the right side. At this time, because the first concave part 60 is formed elongated in the left-and-right direction (refer to FIG. 4), the first convex part 61 enters the first convex part 61 smoothly without interfered with the protruded portion 64 and the others. Additionally, the first convex part 61 enters the first concave part 60 while guided by the first tapered portion 61A (refer to FIG. 6) coming into contact with the edge of the first concave part 60.

When the opening and closing door 40 is further turned, the tip end portion of the second convex part 63 provided at the tip side of the opening and closing door 40 begins to enter the second concave part 62. In detail, the second convex part 63 enters the second concave part 62 along a circular orbit from the front side to the rear side. At this time, because the second concave part 62 is formed elongated in the front-and-rear direction (refer to FIG. 5), the second convex part 63 enters the second concave part 62 smoothly without interfered with the door stop part 66 and the others. Additionally, the second convex part 63 enters the second concave part 62 while guided by the second tapered portion 63A (refer to FIG. 7) coming into contact with the edge of the second concave part 62. As described above, because the tip side of the opening and closing door 40 is slightly hung down, as the second convex part 63 enters the second concave part 62, the tip side of the opening and closing door 40 is slightly brought up.

As shown in FIG. 9, when the second support base 67 buts against the door stop part 66, the turning of the opening and closing door 40 is restricted. That is, the opening and closing door 40 is turned to the closing position P1. At this state, each door side hook 47 is engaged with each main body side hook 42, and the opening and closing door 40 is held in the closing position P1. The first convex part 61 is inserted in the first concave part 60 in the state where the opening and closing door 40 is turned in the closing position P1. The first convex part 61 is positioned in the front-and-rear direction and in the upper-and-lower direction with inserted in the first concave part 60. On the other hand, the second convex part 63 is inserted in the second concave part 62 in the state where the opening and closing door 40 is turned to the closing position P1. The second convex part 63 is positioned in the left-and-right direction and in the upper-and-lower direction with inserted in the second concave part 62. Each opposite roller 27B supported by the opening and closing door 40 is pressed against each main body side roller 27A supported by the conveying face part 43 (refer to FIG. 1). The first convex part 61 is protruded in a direction in which the supports framed 7F and 7R face each other in the state where the opening and closing door 40 is turned to the closing position P1.

As described above, the image forming apparatus 1 of the present embodiment has a configuration that by engaging the concave parts with the convex parts respectively provided in the pair of support frames 7F and 7B and the opening and closing door 40, the opening and closing door 40 is positioned with respect to the pair of support frames 7F and 7B. In detail, when the first convex part 61 is inserted in the first concave part 60 of the support frame 7B and the second convex part 63 is inserted in the second concave part 62 of the support frame 7F, the opening and closing door 40 is precisely turned to the closing position P1. According to the configuration, if the opening and closing door 40 is opened and closed repeatedly, by insertion of the first and second convex parts 61 and 63 in the first and second concave part 60 and 62, it becomes possible to position the opening and closing door 40 with respect to the pair of support frames 7F and 7B directly and precisely. Accordingly, it becomes possible to form the feeding conveying path 10 and the others between the opening and closing door 40 turned to the closing position P1 and the feeding conveying part 43 suitably. This makes it possible to convey the sheet S suitably. The first and second convex parts 61 and 63 are provided not in the apparatus main body 2 but in the opening and closing door 40, and are provided so as not to protrude from the opening and closing conveying part 45 toward the conveying face part 43 outside the opening and closing conveying part 45. Thereby, it becomes possible to decrease a possibility that the user touches the first and second convex parts 61 and 63.

According to the image forming apparatus 1 of the present embodiment, because the opening and closing door 40 is slightly moved in the upper-and-lower direction, if the tip side of the opening and closing door 40 is hung down, the first and second convex parts 61 and 63 can be suitably inserted in the first and second concave parts 60 and 62 while adjusting the position of the opening and closing door 40 in the upper-and-lower direction finely.

The image forming apparatus 1 of the present embodiment has a configuration that the first convex part 61 is inserted in the first concave part 60 to be positioned in the front-and-rear direction (the opposite direction) and in the upper-and-lower direction, and the second convex part 63 is inserted in the second concave part 62 to be positioned in the left-and-right direction (the width direction) and in the upper-and-lower direction. According to the configuration, by insertion of the first and second convex parts 61 and 63 in the first and second concave parts 60 and 62, it becomes possible to position the opening and closing door 40 with respect to the pair of support frames 7F and 7B in the upper-and-lower direction, in the front-and-rear direction and in the left-and-right direction.

If the opening and closing door 40 may be supported by a support member other than the support frames 7F and 7B, because a tolerance of the support member supporting the opening and closing door 40 and a tolerance of a member supporting the conveying face part 43 are accumulated, it is difficult to position the opening and closing door 40 with respect to the conveying face part 42 precisely. Then, each opposite roller 27B may be displaced to each main body side roller 27A, and it is difficult to convey the sheet S suitably. However, according to the image forming apparatus 1 of the present embodiment, because the opening and closing door 40 is directly positioned to the pair of support frames 7F and 7B, compared with a case where the opening and closing door 40 is supported by the support member other than the support frames 7F and 7B, it becomes possible to position the opening and closing door 40 (the opening and closing conveying part 45) with respect to the conveying face part 43 precisely. This makes it possible to press each opposite roller 27B against each main body side roller 27A and to convey the sheet S suitably.

In the image forming apparatus 1 of the present embodiment, the opening and closing door 40 (the turning shaft 53) is supported by the rear support frame 7B. The present disclosure is not limited to the embodiment, and the opening and closing door 40 (the turning shaft 53) may be supported by the front support frame 7F. In this case, the first concave part 60 and the first convex part 61 are provided at the front side, and the second concave part 62 and the second convex part 63 are provided at the rear side. The opening and closing door 40 is formed in the right side face of the apparatus main body 2. However, the present disclosure is not limited to the embodiment. The opening and closing door 40 may be provided in the left side face of the apparatus main body 2. The pair of support frames 7F and 7B are arranged opposite to each other in the front-and-rear direction. The present disclosure is not limited thereto. The pair of support frames 7F and 7B may be arranged opposite to each other in the left-and-right direction. In this case, the opening and closing door 40 may be provided in the front face or the rear face of the apparatus main body 2.

In the image forming apparatus 1 of the present embodiment, the first and second convex parts 61 and 63 are provided in the opening and closing door 40, and the first and second concave parts 60 and 62 are provided in the pair of support frames 7F and 7B. The present disclosure is not limited thereto. The first and second convex parts 61 and 63 may be provided in the pair of support frames 7F and 7B, and the first and second concave parts 60 and 62 may be provided in the opening and closing door 40.

In the description of the present embodiment, the present disclosure is applied to the inkjet type printer 1. The present disclosure may be applied to an electrophotographic type printer. The present disclosure may be applied to a mono color printer, a color printer, a copying machine, a facsimile or a multifunctional peripheral.

While the above description has been described with reference to the particular illustrative embodiments of the image forming apparatus according to the present disclosure, a technical range of the disclosure is not to be restricted by the description and illustration of the embodiment.

The invention claimed is:

1. An image forming apparatus comprising:

a pair of support frames arranged oppositely at both sides of an opening;

an opening and closing door supported by one of the pair of support frames via a turning shaft and turning around the turning shaft between a closing position where the opening and closing door closes the opening to form a part of a conveying path for a sheet and an opening position where the opening and closing door opens the opening; and a positioning structure positioning the opening and closing door to the pair of support frames by engaging a convex part or a concave part provided in the pair of support frames with a concave part or a convex part provided in the opening and closing door in a state where the opening and closing door is turned to the closing position, wherein the positioning structure includes:

a first concave part provided in one of the one support frame arranged on a side closer to the turning shaft and the opening and closing door;

a first convex part provided in the other of the one support frame and the opening and closing door and inserted in the first concave part in the state where the opening and closing door is turned to the closing position;

a second concave part provided in one of the other support frame arranged on a side far from the turning shaft and the opening and closing door; and a second convex part provided in the other of the other support frame and the opening and closing door and inserted in the second concave part in the state where the opening and closing door is turned to the closing position, wherein the first convex part and the second convex part are protruded in directions perpendicular to each other.

2. The image forming apparatus according to claim 1, wherein the first convex part and the second convex part are protruded in directions perpendicular to an axial direction of the turning shaft.

3. The image forming apparatus according to claim 1, wherein the first convex is protruded in a direction in which the support frames faces each other in the state where the opening and closing door is turned to the closing position.

4. The image forming apparatus according to claim 1, wherein the opening and closing door is supported by the one support frame via the turning shaft, the first convex part and the second convex part are provided in the opening and closing door, the first convex part provided in one end at a side of the turning shaft and the second convex part provided in the other end at an opposite side to the turning shaft, and the first concave part and the second concave part are respectively provided in the one support frame and the other support frame.

5. The image forming apparatus according to claim 4, wherein the other support frame includes a door stop part, protruding toward the one support frame, against which the opening and closing door turned to the closing position is butted, and the second concave part is formed in the door stop part.

6. The image forming apparatus according to claim 1, wherein the pair of support frames are stood with an interval in an opposite direction, the opening and closing door is movable in an upper-and-lower direction along the turning shaft extending in the upper-and-lower direction, the first concave part is formed elongated in a width direction perpendicular to the opposite direction and the upper-and-lower direction, the first convex part is positioned in the opposite direction and the upper-and-lower direction in a state where the first convex part is inserted in the first concave part, the second concave part is formed elongated in the opposite direction, and the second convex part is positioned in the width direction and the upper-and-lower direction in a state where the second convex part is inserted in the second concave part.

7. The image forming apparatus according to claim 6, wherein the support frame at a side of the turning shaft is made of metal plate, and the first concave part is a through hole formed in the support frame at the side of the turning shaft.

8. The image forming apparatus according to claim 1, further comprising:

a conveying face part provided between the pair of support frames and forming the conveying path between the opening and closing door turned to the closing position and the conveying face part;

a main body side roller supported by the conveying face part in a rotatable manner; and an opposite roller supported by the opening and closing door in a rotatable manner and pressed against the main body side roller in the state where the opening and closing door is turned to the closing position.

9. The image forming apparatus according to claim 8, wherein the opening and closing door is openable to a posture where the opening and closing door is perpendicular to an opening face of the opening.

10. An image forming apparatus comprising:

a pair of support frames arranged oppositely at both sides of an opening;

an opening and closing door supported by one of the pair of support frames via a turning shaft and turning around the turning shaft between a closing position where the opening and closing door closes the opening to form a part of a conveying path for a sheet and an opening position where the opening and closing door opens the opening; and a positioning structure positioning the opening and closing door to the pair of support frames by engaging a convex part or a concave part provided in the pair of support frames with a concave part or a convex part provided in the opening and closing door in a state where the opening and closing door is turned to the closing position, wherein the positioning structure includes:

a first concave part provided in one of the one support frame arranged on a side closer to the turning shaft and the opening and closing door;

a first convex part provided in the other of the one support frame and the opening and closing door and inserted in the first concave part in the state where the opening and closing door is turned to the closing position;

a second concave part provided in one of the other support frame arranged on a side far from the turning shaft and the opening and closing door; and a second convex part provided in the other of the other support frame and the opening and closing door and inserted in the second concave part in the state where the opening and closing door is turned to the closing position, wherein the first concave part and the second concave part are opened in directions perpendicular to each other.

11. The image forming apparatus according to claim 10, further comprising:

a conveying face part provided between the pair of support frames and forming the conveying path between the opening and closing door turned to the closing position and the conveying face part;

a main body side roller supported by the conveying face part in a rotatable manner; and an opposite roller supported by the opening and closing door in a rotatable manner and pressed against the main body side roller in the state where the opening and closing door is turned to the closing position.

12. The image forming apparatus according to claim 11, wherein the pair of support frames are stood with an interval in an opposite direction, the opening and closing door is movable in an upper-and-lower direction along the turning shaft extending in the upper-and-lower direction, the first concave part is formed elongated in a width direction perpendicular to the opposite direction and the upper-and-lower direction, the first convex part is positioned in the opposite direction and the upper-and-lower direction in a state where the first convex part is inserted in the first concave part, the second concave part is formed elongated in the opposite direction, and the second convex part is positioned in the width direction and the upper-and-lower direction in a state where the second convex part is inserted in the second concave part.

13. The image forming apparatus according to claim 11, wherein the opening and closing door is openable to a posture where the opening and closing door is perpendicular to an opening face of the opening.

14. The image forming apparatus according to claim 12, wherein the opening and closing door is supported by the one support frame via the turning shaft, the first convex part and the second convex part are provided in the opening and closing door, the first convex part provided in one end at a side of the turning shaft and the second convex part provided in the other end at an opposite side to the turning shaft, and the first concave part and the second concave part are respectively provided in the one support frame and the other support frame.

15. The image forming apparatus according to claim 14, wherein the one support frame has a protruded portion protruded toward the other support frame, and the first concave part is formed in the protruded portion.

16. The image forming apparatus according to claim 14, wherein the other support frame includes a door stop part, protruding toward the one support frame, against which the opening and closing door turned to the closing position is butted, and the second concave part is formed in the door stop part.

17. The image forming apparatus according to claim 14, wherein the opening and closing door includes an opening and closing conveying part which faces the conveying face part to form the conveying path when the opening and closing door is disposed in the closing position, and the first convex part and the second convex part are provided so as not to protrude from the opening and closing part toward the conveying face part outside the opening and closing conveying part.

* * * * *